US011253070B2

(12) United States Patent
Stanford

(10) Patent No.: US 11,253,070 B2
(45) Date of Patent: Feb. 22, 2022

(54) DRYWALL KIT

(71) Applicant: VBC Tracy LLC, Philadelphia, PA (US)

(72) Inventor: Robert Stanford, Flowery Branch, GA (US)

(73) Assignee: VBC Tracy LLC, Philadelphia, PA (US)

( * ) Notice: Subject to any disclaimer, the term of this patent is extended or adjusted under 35 U.S.C. 154(b) by 0 days.

(21) Appl. No.: 16/722,752

(22) Filed: Dec. 20, 2019

(65) Prior Publication Data

US 2020/0205568 A1 Jul. 2, 2020

Related U.S. Application Data

(60) Provisional application No. 62/786,850, filed on Dec. 31, 2018.

(51) Int. Cl.

| | |
|---|---|
| ***E04B 1/10*** | (2006.01) |
| ***A47B 95/00*** | (2006.01) |
| *E04C 3/36* | (2006.01) |
| *E04C 3/32* | (2006.01) |

(52) U.S. Cl.
CPC ..... *A47B 95/008* (2013.01); *E04C 3/32* (2013.01); *E04C 3/36* (2013.01)

(58) Field of Classification Search
CPC ..... A47B 95/008; E04B 1/08; E04B 2/7457; E04B 1/10; E04B 1/26; E04B 2/58
See application file for complete search history.

(56) References Cited

U.S. PATENT DOCUMENTS

| | | | | |
|---|---|---|---|---|
| 6,427,407 | B1 * | 8/2002 | Wilson | E04B 1/08 52/481.1 |
| 9,593,705 | B2 * | 3/2017 | Call | E04F 13/0832 |
| 10,136,567 | B2 * | 11/2018 | Anderson | H05K 5/0226 |
| 10,448,735 | B2 * | 10/2019 | Carpenter | A47F 7/28 |

* cited by examiner

*Primary Examiner* — Brian E Glessner
*Assistant Examiner* — Daniel J Kenny
(74) *Attorney, Agent, or Firm* — Volpe Koenig

(57) ABSTRACT

A drywall kit is provided including a wall frame, a drywall section, and a cabinet. The wall frame includes a top plate, a bottom plate, and a plurality of vertical studs. A first vertical stud includes a first hole and a first bolt screwed into the first hole. A second vertical stud includes a second hole and a second bolt screwed into the second hole. The drywall section includes a third hole which aligns with the first hole and a fourth hole which aligns with the second hole. The cabinet includes a back panel. The back panel includes a fifth hole which aligns with the first hole and a sixth hole which aligns with the second hole. The cabinet and the drywall section are secured to the wall frame via the first bolt and the second bolt. A method of installation is also provided.

20 Claims, 7 Drawing Sheets

DRYWALL KIT

CROSS REFERENCE TO RELATED APPLICATION

This application claims the benefit of U.S. Provisional Application No. 62/786,850 filed on Dec. 31, 2018 for DRYWALL KIT, which is incorporated by reference as if fully set forth.

FIELD OF INVENTION

The present invention relates generally to the art of construction, and more specifically to the installation of a drywall section and a cabinet.

BACKGROUND

Typically, when a bathroom is built, the wall frame is constructed by installing a bottom plate, vertical studs, and top plate. The drywall section must be measured, cut, aligned, and held in place while being nailed or screwed to the vertical studs of the wall frame. Moreover, the drywall section behind the bathroom cabinet must have openings to accommodate plumbing and electrical. These opening are also aligned, measured, and cut on site. The bathroom cabinet must be installed to the drywall and vertical studs. This process involves numerous tedious steps and requires precise alignment which is time consuming.

SUMMARY

A drywall kit that can be quickly and efficiently installed on a job site is provided. The drywall kit includes a wall frame, a drywall section, and a cabinet. The wall frame includes a plurality of vertical studs. A first stud of the plurality of studs includes a first fastener installed in a first hole. A second stud of the plurality of studs includes a second fastener installed in a second hole. The drywall section includes a third hole configured to align with the first hole and a fourth hole configured to align with the second hole. The cabinet includes a back panel. The back panel includes a fifth hole configured to align with the first hole and a sixth hole configured to align with the second hole. The first fastener and the second fastener are each configured to align and secure the drywall section and the cabinet to the plurality of vertical studs.

A method of installing a wall and cabinet is also provided. The method includes installing a wall frame. The wall frame includes a plurality of vertical studs. A first stud of the plurality of vertical studs includes a first fastener installed in a first hole. A second stud of the plurality of vertical studs includes a second fastener installed in a second hole. The method also includes backing out the first fastener from the first hole and the second fastener from the second hole. The method includes installing a drywall section. The drywall section has a third hole configured to align with the first hole and a fourth hole configured to align with the second hole. The drywall section is installed by sliding the first fastener through the third hole and the second fastener through the fourth hole. The method includes installing a cabinet. The cabinet includes a back panel. The back panel includes a fifth hole configured to align with the first hole and a sixth hole configured to align with the second hole. The cabinet is installed by sliding the first fastener through the fifth hole and the second fastener through the sixth hole. The method includes threading a first nut onto the first fastener and a second nut onto the second fastener and driving the first fastener in the wall frame via the first nut and the second fastener into the wall frame via the second nut. The nuts and fasteners are driven into the wall frame until the drywall section is secured against the wall frame and the cabinet is secured against the drywall section.

BRIEF DESCRIPTION OF THE DRAWINGS

The foregoing summary, as well as the following detailed description will be better understood when read in conjunction with the appended drawings. For the purpose of illustration, there is shown in the drawings different embodiments. It should be understood, however, that the teachings are not limited to the precise drywall kit arrangement and method shown.

DETAILED DESCRIPTION

Figures 1A, 1B:
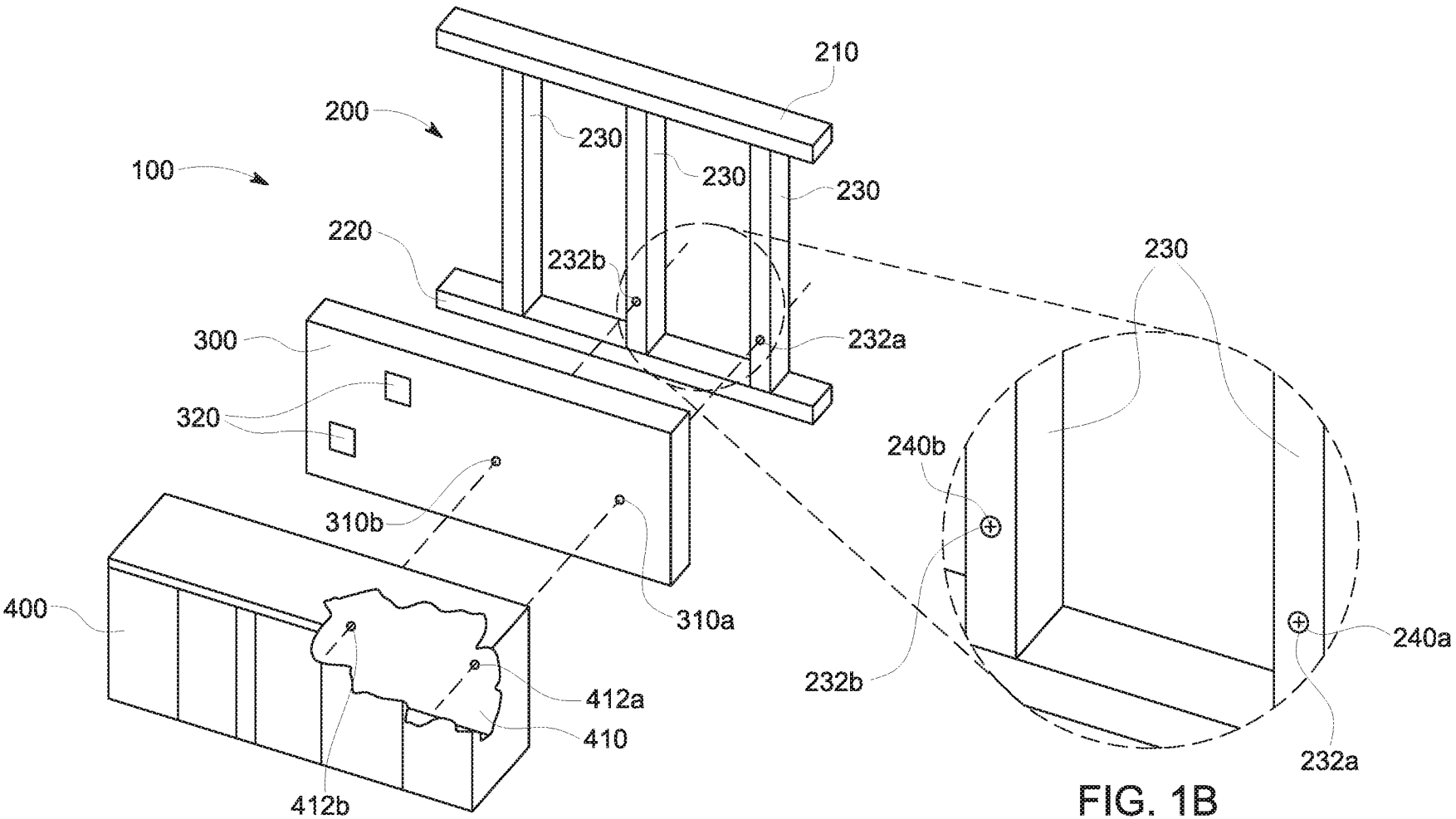
FIG. 1A is an exploded view of a drywall kit.
FIG. 1B is a magnified view of a first fastener and a second fastener installed in vertical studs.

A drywall kit is provided that includes a wall frame, a drywall section, and a cabinet. The drywall kit may be assembled offsite at a factory and easily and efficiently shipped to a job site. Once at the job site, the drywall kit may be quickly and easily installed in a room such as a bathroom. The wall frame includes a plurality of vertical studs. A first stud includes a first fastener installed in a first hole and a second stud includes a second fastener installed in a second hole. The fasteners are located in a position to align and secure a cabinet. A third hole in a drywall section aligns with the first hole and first fastener and a fourth hole in a drywall section aligns with the second hole and second fastener. The first fastener extends through the third hole in the drywall section and the second fastener extends through the fourth hole in the drywall section. The cabinet includes a fifth hole that aligns with the first hole and first fastener and a sixth hole that aligns with the second hole and second fastener. The first fastener extends through the fifth hole and the second fastener extends through the sixth hole. A first nut screws onto the end of the first fastener and second nut screws onto the end of the second fastener to secure the cabinet and drywall section to the wall frame.

A method of installing a wall and cabinet is provided. The method decreases the time of installation of a wall and cabinet in a room such as a bathroom thereby cutting construction costs. The method includes installing a wall frame including a plurality of vertical studs. A first stud includes a first fastener installed in a first hole. A second stud includes a second fastener installed in a second hole. The method includes backing out the first fastener and the second fastener. The method includes installing a drywall section including a third hole configured to align with the first hole and first fastener and a fourth hole configured to align with the second hole and second fastener. The drywall section is installed by sliding the first fastener through the first hole and the second fastener through the second hole. The method includes installing a cabinet including a fifth hole configured to align with the first hole and first fastener and a sixth hole configured to align with the second hole and second fastener. The cabinet is installed by sliding the first fastener through the fifth hole and the second fastener through the sixth hole. The method includes threading a first nut onto the first fastener and a second nut onto the second fastener, and driving the first fastener into the wall frame via the first nut and the second fastener into the wall frame via the second nut until the drywall section is secured against the wall frame and the cabinet is secured against the drywall section.

The drywall kit and the method of installation allows a wall frame, drywall section, and cabinet to be prepared for installation off site, and once at the job site, the wall frame, drywall section, and cabinet can be installed with minimal tools and without the need to measure, cut, and align the components.

FIG. 1A is an exploded view of a drywall kit 100. As shown in FIG. 1A, the drywall kit 100 includes a wall frame 200, a drywall section 300, and a cabinet 400. The drywall section 300 is secured to the wall frame 200 and the cabinet 400 is secured to the drywall section 300 and the wall frame 200. The wall frame 200 and drywall section 300 support the cabinet 400 and the wall frame 200 supports the drywall section 300.

The wall frame 200 becomes a wall frame in a room such as a bathroom or kitchen. The wall frame 200 may make up a portion of a wall frame of a wall of a room or the wall frame 200 may make up the wall frame of an entire wall of a room. The wall frame 200 includes a top plate 210, a bottom plate 220, and a plurality of vertical studs 230. A first vertical stud 230 includes a first hole 232*a*. A second vertical stud 230 includes a second hole 232*b*. Although the wall frame 200 in FIG. 1A depicts two holes 232*a*, 232*b*, the wall frame 200 may include additional holes 232. The holes 232*a*, 232*b* are configured to receive a fastener. The holes 232*a*, 232*b* are located so fasteners installed in the holes 232*a*, 232*b* properly align and secure the drywall section 300 and the cabinet 400. Additionally, the wall frame 200 may be constructed of a rigid material with sufficient strength such as wooden 2×4s or aluminum. The wall frame 200 may be prefabricated.

As shown in FIG. 1A, the drywall kit 100 also includes a drywall section 300. The drywall section 300 includes a third hole 310*a* and a fourth hole 310*b*. The third hole 310*a* in the drywall section 300 is located so that the third hole 310*a* aligns with the first hole 232*a* in the vertical stud 230 of the wall frame 200 when the drywall section 300 is installed. Similarly, the fourth hole 310*b* in the drywall section 300 is located so that the fourth hole 310*b* aligns with the second hole 232*b* in the vertical stud 230 of the wall frame 200 when the drywall section 300 is installed. The holes 310*a*, 310*b* are also positioned on the drywall section 300 to properly align the drywall section 300 when it is installed. The drywall section 300 may be properly aligned when the vertical edges of the drywall section 300 are approximately perpendicular to the floor and ceiling of the room in which the drywall section 300 is installed and the horizontal edges are approximately parallel to the floor and ceiling of the room in which the drywall section 300 is installed. The drywall section 300 may also be properly aligned with the wall frame 200 and/or other adjacent drywall sections. Although FIG. 1A depicts a drywall section 300 with two holes 310*a*, 310*b*, the drywall section 300 may include additional holes 310. The number and location of the holes 310 in the drywall section 300 should coordinate with the number and location of the holes 232 in the wall frame 200. The drywall section 300 may also include at least one opening 320. The openings 320 allow plumbing and/or electrical utilities to be accessed through the drywall section 300. Additionally, the drywall section 300 may be precut in the factory or cut on the job site. The drywall section 300 becomes the wall of the room. The drywall section 300 may be dimensioned so that the drywall section 300 becomes a portion of a wall in a room or an entire wall of a room.

As shown in FIG. 1A, the drywall kit 100 also includes a cabinet 400. The cabinet 400 may be a cabinet 400 for a bathroom, kitchen, etc. The cabinet 400 may be a vanity for a bathroom. The cabinet 400 in FIG. 1A is depicted with a section cut away to show the back panel 410 of the cabinet 400. As shown in FIG. 1A, the back panel 410 of the cabinet 400 includes a fifth hole 412*a* and a sixth hole 412*b*. The fifth hole 412*a* in the back panel 410 is located so that the fifth hole 412*a* aligns with the first hole 232*a* in the vertical stud 230 of the wall frame 200 when the cabinet 400 is installed. The fifth hole 412*a* also aligns with the third hole 310*a* in the drywall section 300. Similarly, the sixth hole 412*b* in the back panel 410 is located so that the sixth hole 412*b* aligns with the second hole 232*b* in the vertical stud 230 of the wall frame 200. The sixth hole 412*b* also aligns with the fourth hole 310*b* in the drywall section 300. The holes 412*a*, 412*b* are placed in the back panel at positions to properly align the cabinet 400 when it is installed. The cabinet 400 may be properly aligned when the vertical edges of the cabinet 400 are approximately perpendicular with the floor and ceiling and the horizontal edges are approximately parallel to the floor and ceiling.

FIG. 1B is a magnified view of a first fastener 240*a* and a second fastener 240*b* installed in the first hole 232*a* and the second hole 232*b* respectively. As shown in FIG. 1B, a first fastener 240*a* is installed into the first hole 232*a*, and a second fastener 240*b* is installed into the second hole 232*b*. The fasteners 240*a*, 240*b* may be a machine bolt or any type of bolt/fastener. More specifically, the first fastener 240*a* and the second fastener 240*b* may be headless threaded bolts that screw into the first hole 232*a* and the second hole 232*b*. Initially, the first fastener 240*a* and the second fastener 240*b* may be screwed into the first hole 232*a* and the second hole 232*b* until the end of the first fastener 240*a* and the end of the second fastener 240*b* are approximately flush with the surfaces of the vertical studs 230. The ends of the fasteners 240*a*, 240*b* may initially be flush with the surfaces of the vertical studs 230 for safety and damage protection purposes during shipping and handling. Moreover, the ends of the fasteners 240*a*, 240*b* may include a mechanism to screw and unscrew the fastener 240*a*, 240*b* from the wall frame 200. For example, as shown in FIG. 1B, the ends of the fasteners 240*a*, 240*b* may include a Phillips screw drive. Alternatively, the head of the fasteners 240*a*, 240*b* may include a slotted, combination, hex, one way, Robertson, or torx screw drives. The holes 232*a*, 232*b* and the fasteners 240*a*, 240*b* are positioned on the studs 230 at a location to align and secure the drywall section 300 and the cabinet 400.

The first fastener 240*a* and the second fastener 240*b* are used to align and install the drywall section 300 and the cabinet 400 to the wall frame 200. This alignment and installation process is accomplished by gradually unscrewing or backing out each fastener 240*a*, 240*b* to accommodate the drywall section 300 and the back panel 410 of the cabinet 400. The fasteners 240*a*, 240*b* are long enough to remain secured and threaded in the vertical studs 230 after being backed out to accommodate the drywall section 300 and the back panel 410 of the cabinet 400. This process is discussed in further detail herein.

Figure 2:
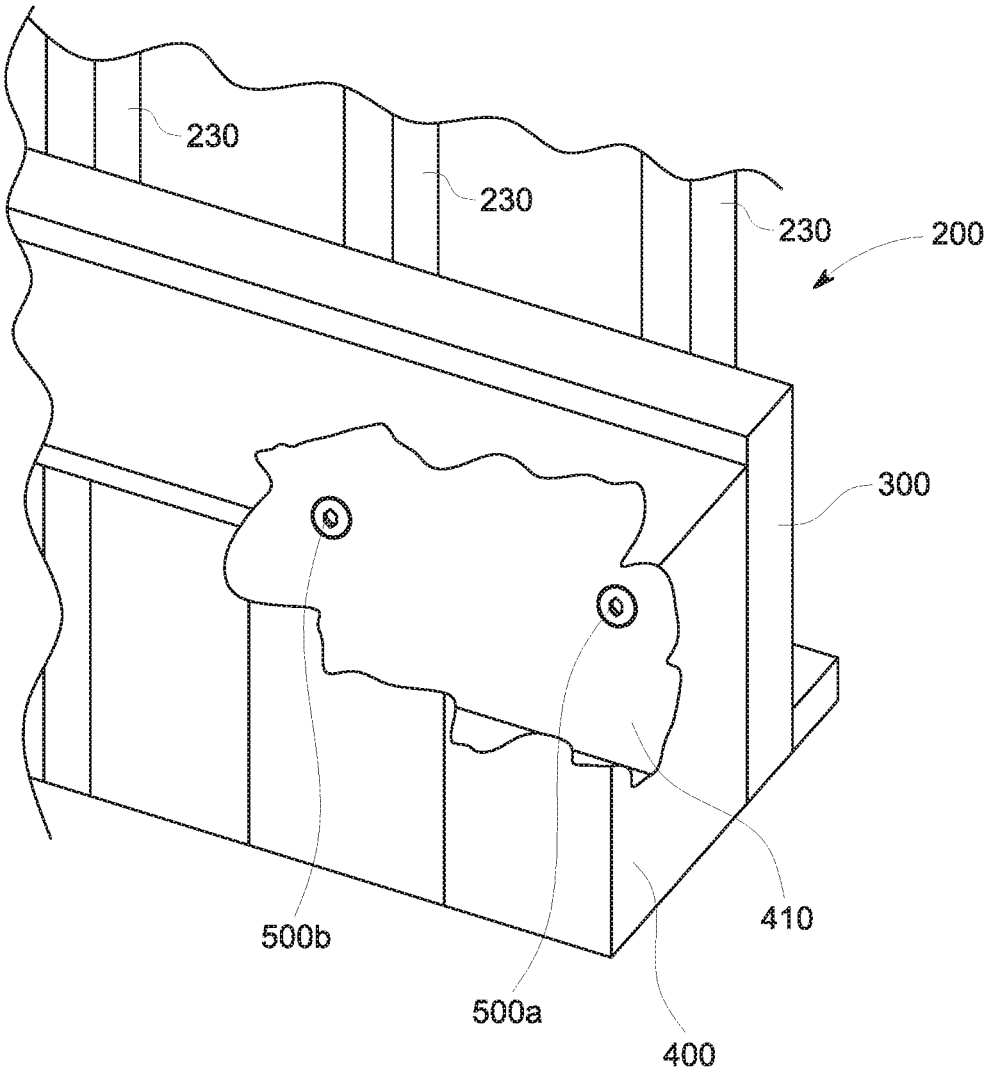
FIG. 2 is a front perspective view of the drywall kit installed with a cut away portion of the cabinet.

FIG. 2 is a front perspective view of the drywall kit 100 installed with a cut away portion of the cabinet 400. As shown in FIG. 2, the drywall section 300 and the cabinet 400 are secured to the wall frame 200 by a first nut 500*a* screwed onto the first fastener 240*a* (not visible in FIG. 2) and a second nut 500*b* screwed onto the second fastener 240*b* (not visible in FIG. 2). The nuts 500*a*, 500*b* may be cap nuts which include a mechanism to screw the cap nuts and fasteners 240*a*, 240*b* into the wall frame 200. As shown in FIG. 2, the mechanism may be a torx screw drive. Alternatively, the mechanism may be a slotted, combination, hex, one way, Robertson, or Phillips screw drive.

Figure 3:
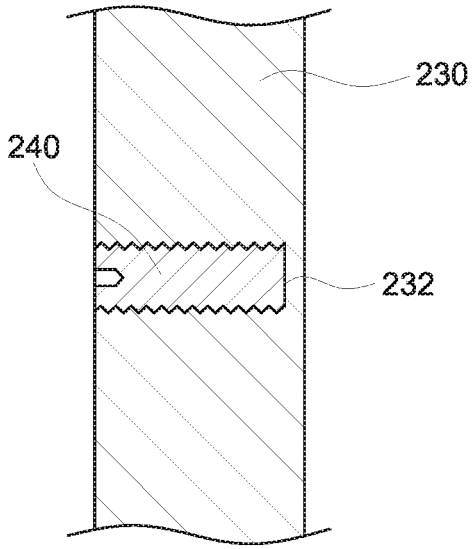
FIG. 3 is a section view of a fastener and a vertical stud.

FIGS. 3-6 show the process of aligning and securing the cabinet 400 and drywall section 300 to the wall frame 200. FIG. 3 is a section view of a fastener 240 and a vertical stud 230 of the drywall kit 100. As shown in FIG. 3, initially, the fastener 240 may be screwed into the vertical stud 230 with the end of the fastener 240 flush with the edge of the vertical stud 230.

Figure 4:
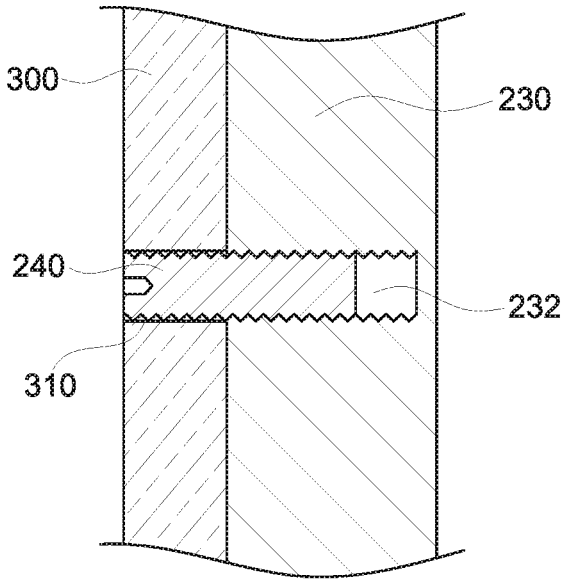
FIG. 4 is a section view of the fastener, the vertical stud, and a drywall section.

FIG. 4 is a section view of the fastener 240, the vertical stud 230, and a drywall section 300. As shown in FIG. 4, the fastener 240 is partially backed out or unscrewed from the hole 232 to accommodate the drywall section 300. The fastener 240 may be partially backed out by unscrewing the fastener 240 via the mechanism to screw and unscrew the fastener 240, such as a Phillips screw drive as discussed previously, with a driving tool, such as a screw driver. When the fastener 240 is backed out enough to accommodate the drywall section 300, the drywall section 300 is placed against the vertical stud 230 by sliding the fastener 240 through the aligned hole 310 in the drywall section 300. The diameter of the hole 310 is slightly larger than the diameter of the fastener 240 so that the hole 310 may receive the fastener 240 and the fastener 240 can guide and align the drywall section 300. Once the drywall section 300 is in place, the drywall section 300 may be secured to the vertical studs 230 with nails or screws (not shown).

Figure 5:
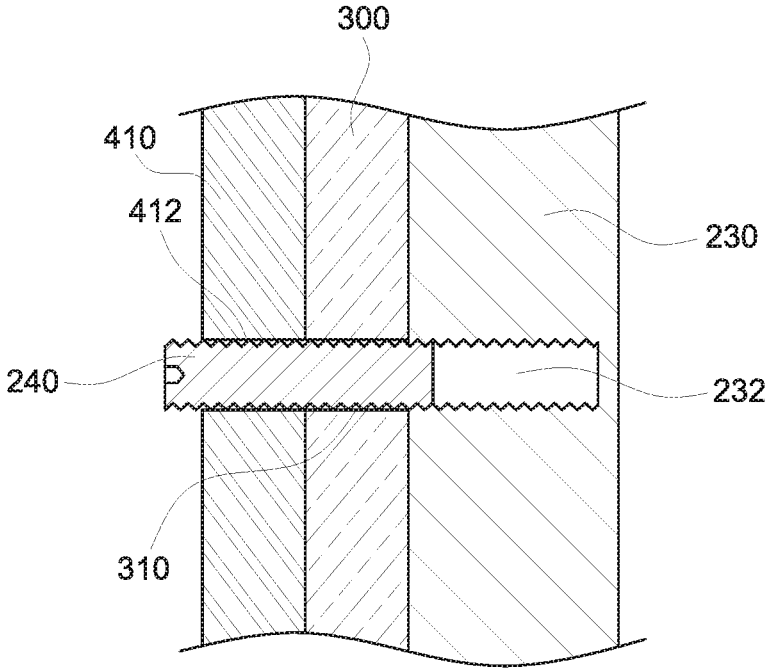
FIG. 5 is a section view of the fastener, the vertical stud, the drywall section, and a back panel of the cabinet.

FIG. 5 is a section view of the fastener 240, the vertical stud 230, the drywall section 300, and a back panel 410 of the cabinet 400. As shown in FIG. 5, the fastener 240 is further backed out or unscrewed from the hole 232 to accommodate the back panel 410 of the cabinet 400. When the fastener 240 is backed out enough to accommodate the back panel 410 of the cabinet 400, the cabinet 400 is placed against the drywall section 300 by sliding the fastener 240 through the aligned hole 412 in the back panel 410. The diameter of the hole 412 is slightly larger than the diameter of the fastener 240 so that the hole 412 may receive the fastener 240 and the fastener 240 can guide and align the cabinet 400.

Figure 6:
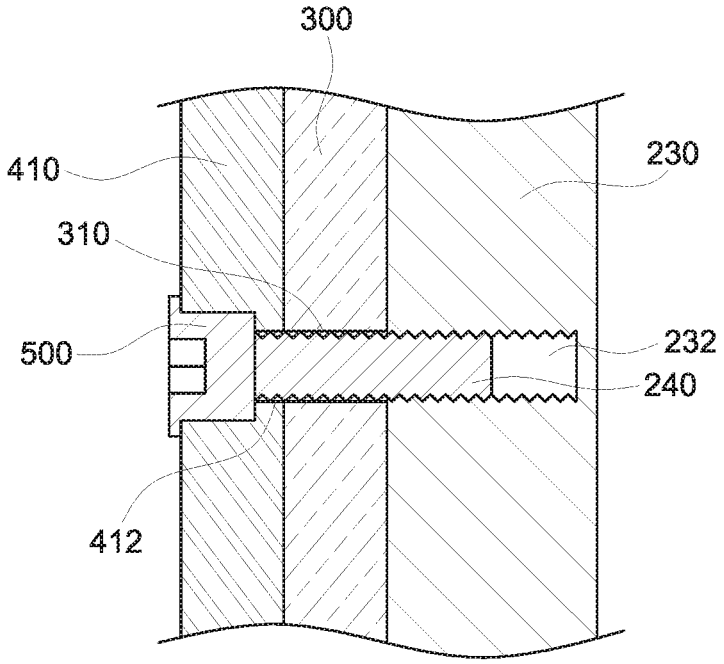
FIG. 6 is a section view of the fastener, the vertical stud, the drywall section, and the back panel of the cabinet secured together via a nut.

FIG. 6 is a section view of the fastener 240, the vertical stud 230, the drywall section 300, and the back panel 410 of the cabinet 400 secured together via a nut 500. As shown in FIG. 6, after the back panel 410 of the cabinet 400 is placed against the drywall section 300, a nut 500 is screwed onto the fastener 240. Then, the proper tool can be used to screw the nut 500 and fastener 240 back into the vertical stud 230 via the a driving mechanism in the nut 500, such as a torx screw drive discussed previously, thereby securing the drywall section 300 and cabinet 400 to the vertical stud 230 of the wall frame 200.

Figure 7:
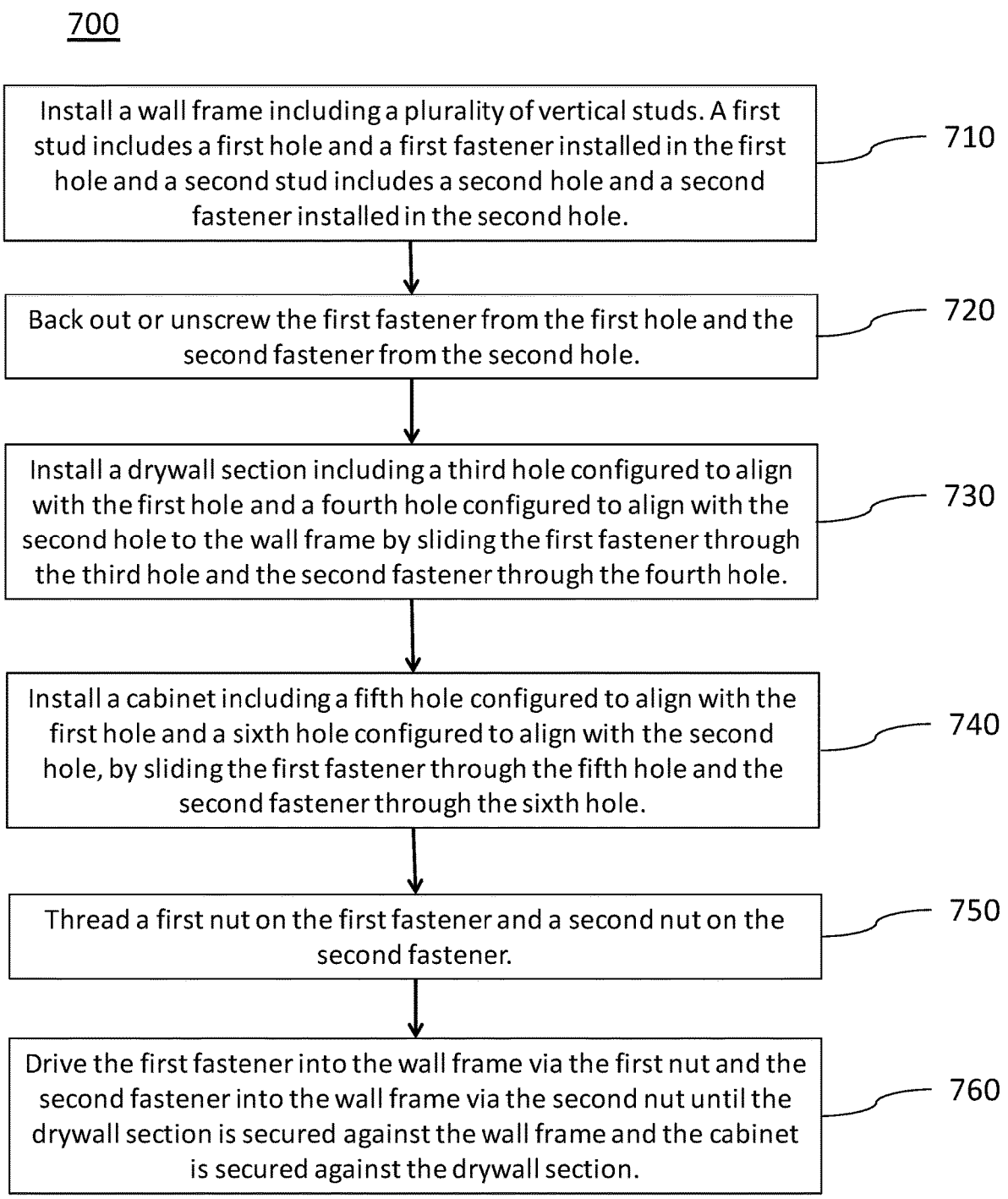
FIG. 7 is a flow chart of a method of installing a wall and cabinet.

FIG. 7 is a flow chart of a method of installing a wall and cabinet 700. The method 700 includes the step 710 of installing a wall frame 200. The wall frame 200 may include the same details and embodiments of the wall frame 200 previously discussed. The wall frame 200 includes a plurality of vertical studs 230. A first stud of the plurality of studs 230 includes a first hole 232*a* and a first fastener 240*a* installed in the first hole 232*a*. A second stud of the plurality of studs 230 includes a second hole 232*b* and a second fastener 240*b* installed in the second hole 232*b*. The wall frame 200 may be installed by securing the wall frame 200 in a room with fasteners such as nails or bolts. A top plate 210 of the wall frame 200 may be secured to the ceiling of the room and a bottom plate 220 may be secured to the floor of the room. The wall frame 200 may be installed around existing mechanical, electrical, and plumbing utilities, or the wall frame 200 may be installed and then mechanical, electrical, and plumbing utilities may be installed in the wall frame 200.

The method 700 includes the step 720 of backing out the first fastener 240*a* from the first hole 232*a* and the second fastener 240*b* from the second hole 232*b*. The fasteners 240*a*, 240*b* may be backed out by unscrewing the fasteners 240*a*, 240*b* from the holes 232*a*, 232*b* via a driving mechanism in the end of the fastener 240*a*, 240*b*. The fasteners 240*a*, 240*b* may be backed out so that an end of the fastener 240*a*, 240*b* is engaged in the hole 232*a*, 232*b* yet enough of the fastener 240*a*, 240*b* extends out from the hole 232*a*, 232*b* to accommodate the thickness of a drywall section 300 or the thickness of a drywall section 300 and a back panel 410 of a cabinet 400.

The method 700 includes the step 730 of installing a drywall section 300. The drywall section 300 may include the same details and embodiments of the drywall section 300 previously discussed. The drywall section 300 includes a third hole 310*a* configured to align with the first hole 232*a* and the first fastener 240*a* and a fourth hole 310*b* configured to align with the second hole 232*b* and the second fastener 240*b*. The drywall section 300 is installed by sliding the first fastener 240*a* through the third hole 310*a* and the second fastener 240*b* through the fourth hole 310*b*. The placement of the fasteners 240*a*, 240*b* and holes 232*a*, 232*b*, 310*a*, 310*b* aligns the drywall section 300 and eliminates the need to align the drywall section 300 by hand at the job site. Once the drywall section 300 is placed up against the wall frame 200, the drywall section 300 may be secured to the wall frame 200 by driving fasteners through the drywall section 300 into the vertical studs 230. After the drywall section 300 is installed the fasteners 240*a*, 240*b* may be backed out or unscrewed further, if needed, to accommodate a back panel 410 of a cabinet 400.

The method 700 includes the step 740 of installing a cabinet 400. The cabinet 400 may include the same details and embodiments of the cabinet 400 previously discussed. The cabinet 400 includes a back panel 410 including a fifth hole 412*a* configured to align with the first hole 232*a* and the first fastener 240*a* and a sixth hole 412*b* configured to align with the second hole 232*b* and the second fastener 240*b*. The cabinet 400 may be installed by sliding the first fastener 240*a* through the fifth hole 412*a* and the second fastener 240*b* through the sixth hole 412*b*. The placement of the fasteners 240*a*, 240*b* and holes 232*a*, 232*b*, 412*a*, 412*b* aligns the cabinet 400 and eliminates the need to align the cabinet 400 by hand at the job site.

The method 700 includes the step 750 of threading a first nut 500*a* onto the end of the first fastener 240*a* and a second nut 500*b* onto the end of the second fastener 240*a*. The nuts 500*a*, 500*b* may include a driving mechanism to screw the nut 500*a*, 500*b* and fastener 240*a*, 240*b* into the studs 230.

The method 700 includes the step 760 of driving the first fastener 240*a* into the wall frame 200 via the first nut 500*a* and the second fastener 240*b* into the wall frame 200 via the second nut 500*b*. A driving tool is used to screw the nuts 500*a*, 500*b* which are engaged with the fasteners 240*a*, 240*b*, into the cabinet 400, drywall section 300, and wall frame 200. The nuts 500*a*, 500*b* and fasteners 240*a*, 240*b* are driven until the cabinet 400 is secure against the drywall section 300 and the drywall section 300 is secure against the wall frame 200.

Having thus described in detail a preferred selection of embodiments of the present invention, it is to be appreciated and will be apparent to those skilled in the art that many physical changes could be made to the drywall kit and method of installing a wall and cabinet without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A drywall kit comprising:

a wall frame including a plurality of vertical studs;

a first stud of the plurality of vertical studs including a first hole;

a first fastener installed in the first hole;

a second stud of the plurality of vertical studs including a second hole;

a second fastener installed in the second hole;

a drywall section including a third predrilled hole configured to align with the first hole and a fourth predrilled hole configured to align with the second hole; and a cabinet including a back panel, the back panel including a fifth predrilled hole configured to align with the first hole and a sixth predrilled hole configured to align with the second hole;

wherein the first fastener and the second fastener are each configured to unscrew from the first stud and the second stud to receive the drywall section and the cabinet, configured to align the drywall section and cabinet prior to being secured via the aligned holes and configured to secure the drywall section and the cabinet to the first stud and the second stud.

2. The drywall kit of claim 1, wherein the first fastener and the second fastener are each headless threaded bolts.

3. The drywall kit of claim 1, wherein a first nut secures the cabinet and drywall section to the first fastener and a second nut secures the cabinet and drywall section to the second fastener.

4. The drywall kit of claim 3, wherein the first nut and the second nut are each cap nuts with at least one recess configured to receive a driving tool.

5. The drywall kit of claim 4, wherein the at least one recess may be at least one of a torx, slotted, combination, hex, one way, Robertson, and Phillips screw drive.

6. The drywall kit of claim 1, wherein the wall frame is at least one of wood and aluminum.

7. The drywall kit of claim 1, wherein the wall frame further includes a top plate and a bottom plate.

8. The drywall kit of claim 1, wherein the drywall section includes at least one opening.

9. The drywall kit of claim 8, wherein the at least on opening is configured to allow access to mechanical, electrical, and plumbing utilities.

10. A method of installing a wall and cabinet comprising:

installing a wall frame including a plurality of vertical studs, a first stud of the plurality of vertical studs including a first hole and a first fastener installed in the first hole, and a second stud of the plurality of vertical studs including a second hole and a second fastener installed in the second hole;

backing out the first fastener from the first hole and the second fastener from the second hole;

installing a drywall section including a third predrilled hole configured to align with the first hole and a fourth predrilled hole configured to align with the second hole to the wall frame by sliding the first fastener through the third predrilled hole and the second fastener through the fourth predrilled hole;

installing a cabinet including a back panel, the back panel including a fifth predrilled hole configured to align with the first hole and a sixth predrilled hole configured to align with the second hole, by sliding the first fastener through the fifth predrilled hole and the second fastener through the sixth predrilled hole;

threading a first nut onto the first fastener and a second nut onto the second fastener; and driving the first fastener into the wall frame via the first nut and the second fastener into the wall frame via the second nut until the drywall section is secured against the wall frame and the cabinet is secured against the drywall section;

wherein the first fastener and the second fastener are each configured to unscrew from the first stud and the second stud to receive the drywall section and the cabinet, and configured to align the drywall section and cabinet prior to being secured via the aligned holes.

11. The method of claim 10 further including backing out the first fastener from the first hole and the second fastener from the second hole prior to securing the cabinet.

12. The method of claim 10, wherein backing out the first fastener and the second fastener includes partially unscrewing the first fastener from the first hole and partially unscrewing the second fastener from the second hole.

13. The method of claim 10, wherein installing the drywall section includes placing the drywall section up against the wall frame with the first fastener extending through the first hole and the second fastener extending through the second hole.

14. The method of claim 10, wherein installing the cabinet includes placing the cabinet up against the drywall section with the first fastener extending through the first hole and the second fastener extending through the second hole.

15. The method of claim 10, wherein driving the first fastener via the first nut and the second fastener via the second nut further includes using a tool to screw the first nut and the second nut, thereby screwing the first fastener and the second fastener into the wall frame.

16. The method of claim 10, wherein the first fastener and the second fastener are each headless threaded bolts.

17. The method of claim 10, wherein the first nut and the second nut are each cap nuts with at least one recess configured to receive a driving tool.

18. The method of claim 17, wherein the at least one recess may be at least one of a torx, slotted, combination, hex, one way, Robertson, and Phillips screw drive.

19. The method of claim 10, wherein the drywall section includes at least one opening.

20. The method of claim 19, wherein the at least on opening is configured to allow access to mechanical, electrical, and plumbing utilities.

* * * * *